US006386180B1

(12) United States Patent
Gerhardt et al.

(10) Patent No.: US 6,386,180 B1
(45) Date of Patent: May 14, 2002

(54) METHOD AND DEVICE FOR OPERATING AN INTERNAL COMBUSTION ENGINE

(75) Inventors: Juergen Gerhardt, Oberriexingen; Arndt Ehrlinger, Korntal-Muenchingen; Torsten Bauer, Vaihingen; Winfried Langer, Markgroeningen; Frank Bederna, Korntal-Muenchingen; Ulrich Schopf, Bietigheim-Bissingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/646,014

(22) PCT Filed: Jan. 8, 2000

(86) PCT No.: PCT/DE00/00051

§ 371 Date: Nov. 9, 2000

§ 102(e) Date: Nov. 9, 2000

(87) PCT Pub. No.: WO00/42307

PCT Pub. Date: Jul. 20, 2000

(30) Foreign Application Priority Data

Jan. 12, 1999 (DE) ..... 199 00 740

(51) Int. Cl.[7] ..... F02D 41/00
(52) U.S. Cl. ..... 123/350; 123/478; 701/107
(58) Field of Search ..... 123/478–9, 350; 701/103–4, 107

(56) References Cited

U.S. PATENT DOCUMENTS 5,265,575 A * 11/1993 Norota ..... 123/436
5,692,472 A 12/1997 Bederna et al.
5,921,219 A * 7/1999 Frohlich ..... 123/350
5,964,200 A * 10/1999 Shimada et al. ..... 123/305
6,032,644 A * 3/2000 Bederna et al. ..... 123/396
6,076,500 A * 6/2000 Clement ..... 123/362
6,123,056 A * 9/2000 Shimada et al. ..... 123/399
6,205,973 B1 * 3/2001 Bauer ..... 123/294
6,223,721 B1 * 5/2001 Bauer et al. ..... 123/399
6,247,445 B1 * 6/2001 Langer ..... 123/305
6,285,946 B1 * 9/2001 Steinmann ..... 701/110

FOREIGN PATENT DOCUMENTS

| | | |
|---|---|---|
| DE | 196 20 038 | 11/1997 |
| DE | 197 29 100 | 1/1999 |
| DE | 198 29 303 | 1/1999 |
| JP | 04 171245 | 10/1992 |

* cited by examiner

*Primary Examiner*—Thomas N. Moulis
(74) *Attorney, Agent, or Firm*—Walter Ottesen

(57) ABSTRACT

A method and an arrangement for operating internal combustion engines is suggested which is operated in at least one operating state with a lean air/fuel mixture. The fuel mass, which is to be injected, or the injection time, which is to be outputted, is determined in dependence upon a desired value. For monitoring the operability, the actual torque of the engine is determined on the basis of the fuel mass, which is to be injected, or the injection time, which is to be outputted, or the outputted injection time and compared to a maximum permissible torque and a fault reaction is initiated when the actual torque exceeds the maximum permissible torque. Parallel to the above, a quantity, which represents the oxygen concentration in the exhaust gas, is compared to at least one pregiven limit value and a fault reaction is initiated when this quantity exceeds the limit value.

14 Claims, 4 Drawing Sheets

METHOD AND DEVICE FOR OPERATING AN INTERNAL COMBUSTION ENGINE

FIELD OF THE INVENTION

The invention relates to a method and an arrangement for operating an internal combustion engine.

BACKGROUND OF THE INVENTION

Modern control systems are available for operating internal combustion engines and adjust the power of the engine in dependence upon input quantities by controlling the power parameters of the engine. Many different monitoring measures are provided for avoiding unwanted operating situations as a consequence of disturbances and especially because of the disturbances in the electronic control apparatus of the engine control. The monitoring measures ensure a reliable operation of the engine as well as the availability for use thereof. The monitoring of the control of an internal combustion engine on the basis of torque is shown in DE-A 195 36 038 (U.S. Pat. No. 5,692,472). There, a maximum permissible torque is determined at least on the basis of the accelerator pedal position. In addition, the actual torque of the engine is computed in dependence upon engine speed (rpm), ignition angle position and load (air mass, et cetera). The maximum permissible value is compared to the computed current value for monitoring. Fault reaction measures are initiated when the actual value exceeds the maximum permissible value. This monitoring strategy offers a reliable and satisfactory monitoring of internal combustion engines. However, it is based on the measured air mass supplied to the engine. The torque, which is determined from the measured air mass, does not correspond to the actual values in internal combustion engines which are operated at least in an operating state with a lean air/fuel mixture such as direct-injected gasoline engines or diesel engines. For this reason, the described monitoring strategy is useable only to a limited extent. In gasoline internal combustion engines having direct injection in stratified-charge operation, the detected air mass and the adjusted ignition angle are not adequate for computing the actual torque.

SUMMARY OF THE INVENTION

It is the object of the invention to provide a concept for monitoring the control of an internal combustion engine which is operated at least in some operating states with a lean air/fuel mixture.

A monitoring measure for gasoline direct-injected internal combustion engines is known from the non-published DE 197 29 100.7. There, the actual torque of the engine is determined on the basis of the combusted fuel mass and compared to a permissible maximum torque determined on the basis of the accelerator pedal position and a fault reaction is initiated when the actual torque exceeds the maximum torque.

For monitoring an internal combustion engine, which is operated in at least one operating state with a lean air/fuel ratio, it is known from U.S. patent application Ser. No. 09/554,128, filed May 9, 2000 to permit in at least one operating state only operation of the engine with an approximately stoichiometric or rich air/fuel ratio or only an operation with limited air supply and to then monitor the operation of the engine on the basis of at least one operating quantity thereof.

A further individual measure is shown in DE-A1 196 20 038. There, for monitoring a fuel metering system, a signal of a sensor, which detects the exhaust gas composition, is checked for deviations from a pregiven value.

All these individual measures show only solutions for individual problem points, that is, they limit the availability of use of the control system. A monitoring concept, which is satisfactory with the view to availability of use and completeness, is not described.

A procedure is described with permits a complete monitoring of the control of internal combustion engines which are operated in at least an operating state with a lean air/fuel mixture. In a reliable manner, an increase (which is impermissible with respect to the driver command) of the indicated engine torque of such an engine is avoided as a consequence of a software defect or a hardware defect. The indicated engine torque is the torque of the engine which is generated directly by the combustion of the air/fuel mixture. The torque, which is outputted by the engine, is computed therefrom while considering loss torques and consumer torques.

It is especially advantageous that the accuracy of the monitoring is improved because not the air flowing over the throttle flap is used as indicator for the indicated torque but the fuel mass injected into the cylinder. This fuel mass is the quantity determining torque in lean and stoichiometric operating conditions.

It is especially advantageous when the fuel mass, which is injected into the cylinder, is determined from the injection time or possibly even only in specific operating states when the fuel mass, which is injected into the cylinders, is determined from the air mass, which is supplied to the engine, and the exhaust-gas composition. In specific operating states, a monitoring on the basis of a quantity for the exhaust-gas composition such as a measure for the oxygen content, , can take place as an additional measure for monitoring the engine. This additional measure secures the torque monitoring and thereby further improves the same.

Further, the input of a trace of the permissible torque in dependence upon at least one of the quantities: engine speed, engine temperature and driver command (accelerator pedal position) is advantageous for which driver command, at very small pedal angles, a maximum permissible torque is less than the zero load and wherein a permissible torque up to maximally zero load is assigned for mean pedal angles and wherein a maximum permissible torque is assigned in accordance with a pregiven relationship to large pedal angles. In this way, a satisfactory response of the torque monitoring is achieved when there is a fault.

It is further advantageous that special operating states can be considered during monitoring such as active measures for catalytic converter protection, catalytic converter heating and/or methods for holding the catalytic converter warm.

BRIEF DESCRIPTION OF THE DRAWINGS

The invention will be explained below in greater detail with respect to the embodiments shown in the drawings.

DESCRIPTION OF THE PREFERRED EMBODIMENT OF THE INVENTION

Figure 1:
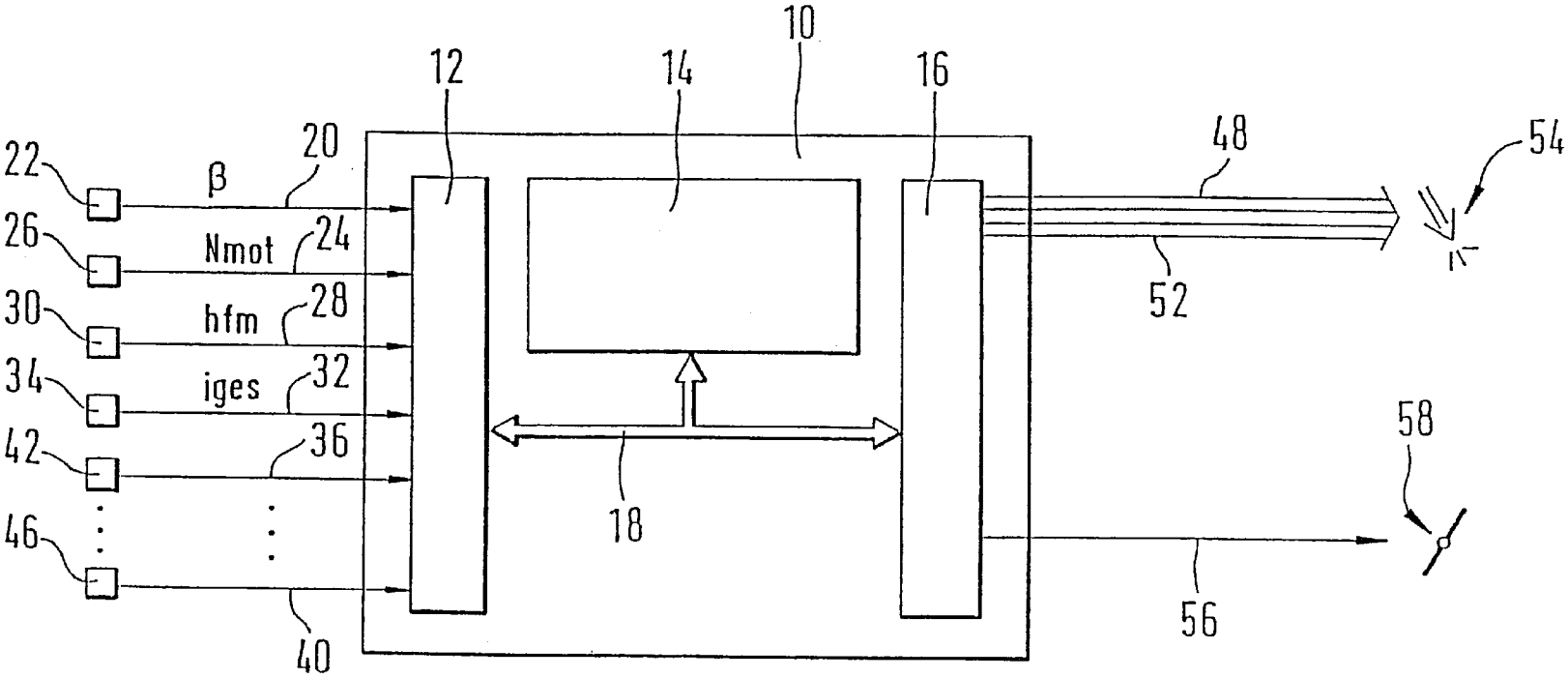
FIGS. 1 and 2 show a control arrangement for controlling an internal combustion engine; whereas, a preferred embodiment of the solution according to the invention is shown in FIG. 3 as a flowchart, which represents a program implemented in the microcomputer of the control arrangement. The input of the permissible torque in dependence upon engine speed (rpm) is shown in FIG. 4 based on a characteristic line for a preferred case of application.

In FIG. 1, a control apparatus 10 is shown which includes as elements at least an input circuit 12, at least one microcomputer 14, an output circuit 16 and a communication system 18 connecting these elements. Input lines lead to the input circuit 12 and signals are supplied via these lines from corresponding measuring devices. The signals represent operating variables or operating variables can be derived therefrom. With reference to the solution according to the invention described below, the following are shown in FIG. 1: an input line 20 which connects the control apparatus to a measuring device 22 which determines a quantity representing the degree of actuation β of the accelerator pedal. Furthermore, an input line 24 is provided which originates from a measuring device 26 and the quantity, which represents the engine rpm nmot, is supplied via this line. Further, an input line 28 connects the control apparatus 10 to a measuring device 30 which outputs a signal representing the supplied air mass HFM. An input line 32 conducts a quantity from a measuring device 34 which corresponds to the actual transmission ratio IGES in the drive train. Further, input lines 36 to 40 are provided which supply signals from measuring devices 42 to 46 which represent operating quantities. Examples for operating quantities of this kind which find application in the control of the engine are: temperature quantities, the position of the throttle flap angle, et cetera. For controlling the engine, output lines 48 to 52 lead away from the output circuit 16 in the embodiment shown in FIG. 1 for controlling the injection valves 54 as well as an output line 56 for controlling the electric-motorically adjustable throttle flap 58. In addition, there are at least lines (not shown) for controlling the ignition.

Figure 2:
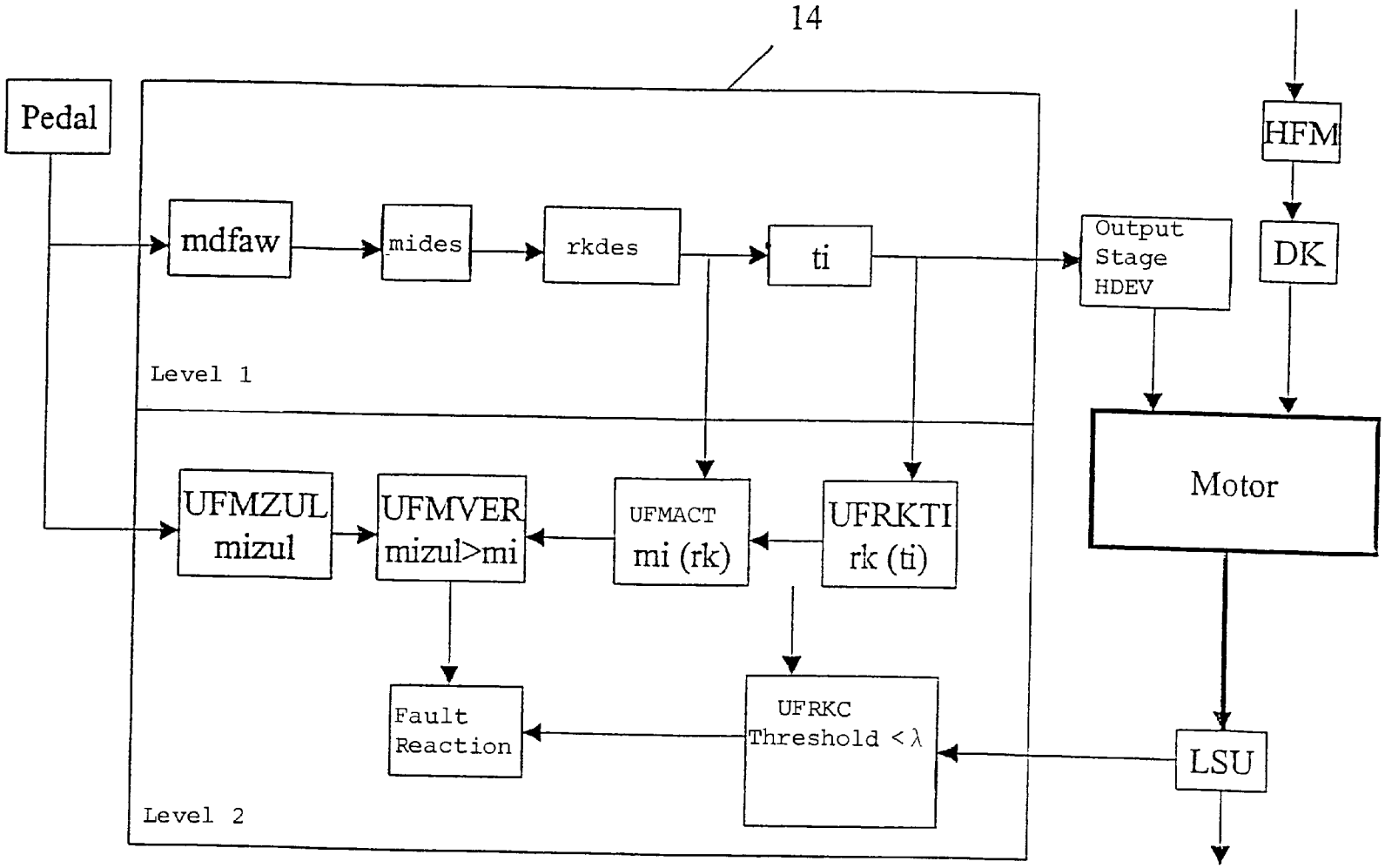

FIG. 2 shows a basic structure of programs for engine control and for monitoring this control. The programs run in the microcomputer 14 of the control apparatus 10. In the microcomputer 14, two program levels, level 1 and level 2, are provided which are separate from each other. In the first level, the control programs run and, in the second level, the monitoring programs run.

In the first level, the fuel supply and the air supply are controlled in accordance with a predetermined air/fuel ratio on the basis of the degree of actuation β of the accelerator pedal (pedal). Depending upon the degree β of actuation, a driver command torque mdafw is formed from characteristic fields and/or computations while considering the engine rpm as may be required. This driver command torque or another desired torque, which is pregiven by another control system, forms the desired value for the indicated torque mides. This is converted into a desired value rkdes for the fuel mass to be injected. The desired value for the fuel mass to be injected is then converted into an injection time ti while considering fuel pressure as may be required. A pulse of this length is then outputted to the output stage of the injection valve(s) HDEV. In selected operating states, the throttle flap DK is also electrically adjusted which, however, is not shown in FIG. 1*a*.

The control unit shown in FIG. 2 functions, depending upon embodiment, for the control of an engine having intake manifold injection which is driven lean or functions to control an engine having gasoline direct injection or functions to control a diesel engine.

The above-described operation of the control is to be monitored to ensure the operational reliability of this control and/or the availability of use of this control. The following monitoring concept is utilized in the preferred embodiment. The corresponding program runs in level 2.

First, the injected fuel mass rk is determined based on the injection time ti, which is outputted by the control apparatus, and possibly additional quantities such as the fuel pressure UFRKTI. With respect to the injection time, measured values or the content of memory cells of the control apparatus are used for computation. In accordance with this, the determined injected fuel mass rk is converted into an outputted engine torque mi while considering degrees of efficiency such as the degree of efficiency of the injection time point, the ignition time point, the exhaust-gas composition (detected via a λ probe LSU), the degree of dethrottling (UFMACT), et cetera. The degree of efficiency considers the extent of the influence of an operating quantity, which deviates relative to standard values, on the torque of the engine. The permissible torque mizul is determined at least from driver command (or accelerator pedal position β) and/or, as required, engine speed (rpm) via a characteristic field or a simplified function model (UFMZUL). The principle trace of the permissible torque is such that, for small pedal angles (for example, less than 2%), the maximum permissible torque leads to a torque at the output shaft of the engine less than zero load or zero load and, at greater pedal angles (for example, up to 10%) this leads to maximally zero load (zero torque, overrun monitoring). Zero torque is the load of the engine at which the engine no longer outputs a positive torque. For larger pedal angles (for example, greater than 10%), the permissible torque is so pregiven that load values greater than zero load arise. Additionally, the permissible indicated torque can be converted into the outputted torque while considering consumer torques and loss torques of the engine and can thereby be converted into a load value of the engine.

The determined torque mi is compared to the maximum permissible torque MIZUL (UFMVER). Alternatively, the determined torque is compared to the desired torque mides and the desired torque mides is compared to the permissible torque. In the first embodiment, a fault is detected when the actual torque is greater than the permissible torque. For the alternative, a fault is detected when the determined actual torque is greater than the pregiven desired torque and/or, at the same time, the pregiven desired torque is greater than the permissible torque.

In addition to this monitoring measure, the engine is to be monitored at small pedal angles so that no fuel is injected. This monitoring takes place when no exception conditions are active such as catalytic converter protection, catalytic converter heating measures or catalytic converter warm-holding measures. A fault is detected when fuel is injected under these conditions.

To ensure torque monitoring in the case of fault conditions (such as leaks, output stage defects, unwanted fuel supply from the tank venting or from the crankcase), it is provided to monitor, for a switched-off fuel injection (ti=0 and/or rk=0), a measured value λ for the oxygen content of the exhaust gas as to reaching a threshold value (threshold) (UFRKC). The threshold value of this lambda monitoring results from the tolerance of the lambda probe LSU. The lambda probe LSU is checked with a two-point lambda probe for defects at operating points at which lambda<or=1. Alternatively, and for injection times greater than zero, monitoring takes place as to whether the measured lambda lies in an operating point dependent permitted region. The permitted lambda region is computed (while considering the positive and negative tolerances of the lambda probe) from the measured air mass (detected by the air mass sensor HFM) supplied to the engine and the desired fuel mass or the determined fuel mass. When the lambda monitoring responds, a fault reaction is carried out, for example, a λ=1 operation is carried out and monitored as a substitute function. The actual torque is computed from the air mass instead of from the fuel mass and, to monitor the operation, the monitoring strategy, which is known from the state of the art, is carried out. Alternatively, an injected fuel mass is determined from supplied measured air mass HFM and exhaust-gas composition and compared to a limit value (for example, rk=0) which is pregiven at least for one operating state.

Figure 3:
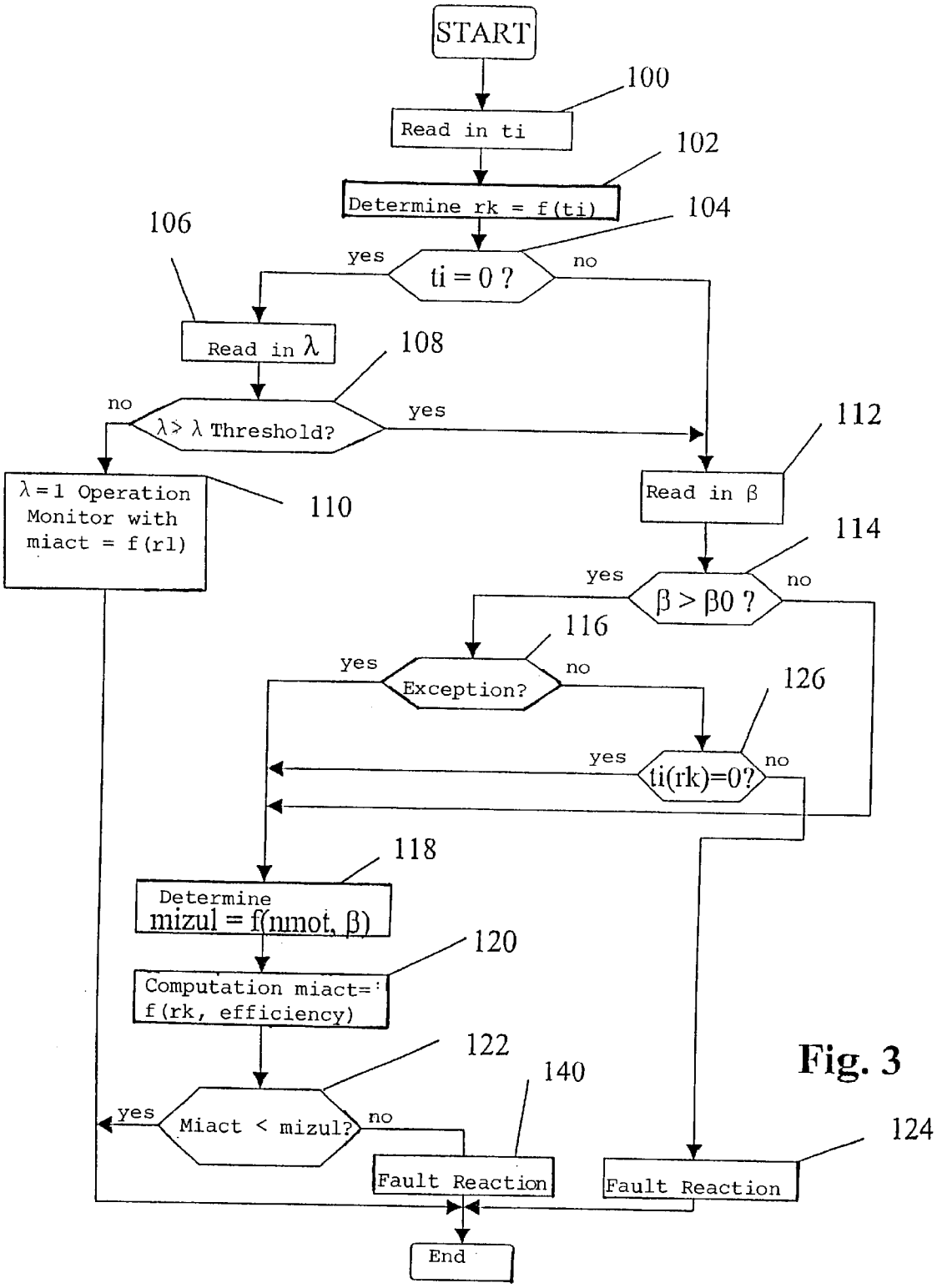

In FIG. 3, a flowchart is shown which shows a preferred embodiment of the monitoring concept as a computer program. The program shown is run through at pregiven time intervals.

In step 100, the outputted injection time ti is read in. The outputted injection time is either a measured signal (for example, in the region of each injection valve or in the region of the output of the control unit) or is the injection time, which is outputted by the microprocessor and stored in a memory cell. On the basis of the read-in injection time, the actually injected relative fuel mass rk is determined in step 102. The computation of the relative fuel mass (that is, the fuel mass referred to a standard value) takes place in dependence upon the injection time and, in the preferred embodiment, on the basis of a characteristic line which is dependent upon the fuel pressure in the rail. In the following step 104, a check is made as to whether the injection time is zero, that is, whether an operating state is present wherein the fuel injection is switched off. If the fuel supply is switched off, then, in step 106, a monitoring on the basis of the measured value λ for the oxygen content in the exhaust gas is carried out to determine leakages, output stage defects, unwanted fuel metering from a tank venting or from the crankcase. For this purpose, in step 106, the measured value λ or a value derived from the measured signal is read in by the lambda probe and a check is made in the next step 108 as to whether the λ value exceeds a pregiven threshold (λ threshold). This threshold value results from the tolerance of the lambda probe and is fixed in the context of the application. If the lambda threshold is not exceeded, then it can be assumed that one of the above-mentioned faults is present and fuel reaches the cylinders of the engine notwithstanding a missing injection time.

In this case, and in accordance with step 110, an operation of the engine is initiated in which the air/fuel mixture is stoichiometric, that is, the λ value is 1. The engine is therefore operated in homogeneous operation. The further monitoring takes place on the basis of the actual torque which is computed on the basis of the relative charge, that is, the supplied air mass as shown in the state of the art initially mentioned herein. Thereafter, the program is ended and run through in the next interval.

In another advantageous embodiment, the lambda monitoring is carried out not only for an injection time of zero but also for injection times greater than zero. In this case, a check is made as to whether the lambda value lies in a tolerance band dependent upon the operating point. In this case, the permissible tolerance band for the lambda value is computed while considering the positive and negative tolerance of the lambda probe from the measured air mass, which is supplied to the engine, and the desired fuel mass or the determined fuel mass. If the measured lambda value exceeds or drops below the pregiven tolerance range, then the measure of step 110 is initiated; otherwise, the program continues as in the case of a Yes-answer in step 108.

If the injection time in the preferred embodiment shown in FIG. 3 is not zero (No-answer in step 104) or the lambda condition, which is checked in step 108, is satisfied, then in accordance with step 112, the accelerator pedal angle f or the driver command, which is derived therefrom, is read in. The region of small accelerator pedal angles, which is checked in step 114, is, in a preferred embodiment, the region of the accelerator pedal which is less than 2% (completely released accelerator pedal 0%, fully actuated accelerator pedal 100%) and represents a released accelerator pedal. In the next step 114, a check is made as to whether the pedal angle is greater than a specific lower limit value which delimits a region of smaller accelerator pedal angles or driver command torques relative to the remaining operating range. If this is the case, then a check is made in step 116 as to whether an exceptional operating state is present which leads to an injection of fuel which is not planned for. Operating regions of this kind are, for example, operating regions in which, for protecting the catalytic converter or for heating the catalytic converter or for holding the catalytic converter warm, a larger quantity of fuel is injected compared to the current operating state. If an exceptional operating situation of this kind is present, then the program is continued with the next described torque monitoring in the lean operation or in the stratified layer operation in accordance with steps 118 to 124. The engine is in overrun operation if no such exceptional operating state is present. In this operating state and at least at engine speeds (rpm) above a limit value, the injection time or the injected fuel mass is zero as a consequence of the fuel cutoff (operating in the normal operation) in overrun operation. For this reason, a check is made in step 126 as to whether the injection time or the fuel mass is zero when the engine speed has exceeded a specific rpm. If the injection time or the fuel mass is not zero, then a fault is present so that a fault reaction is initiated in accordance with step 124. In the preferred embodiment, this fault reaction lies, for example, in limiting the air supply to the engine, in a transition from a homogeneous operation with stoichiometric mixture or in a limiting of the engine power. The program is ended after step 124 and the program is run through again at the next interval.

Figure 4:
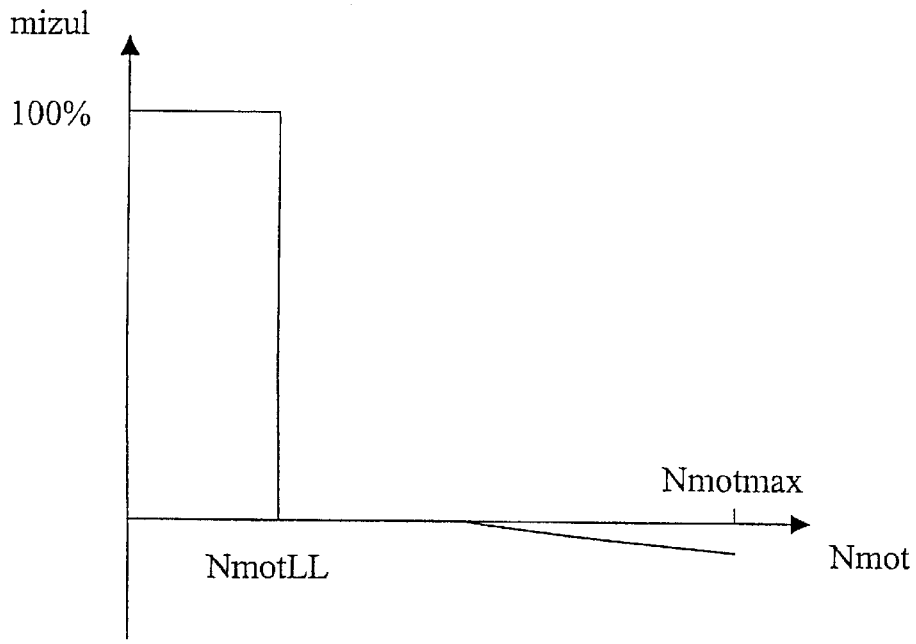

In the exceptional operating state in accordance with step 116, and for a pedal angle above the limit angle β0 in accordance with step 114 as well as for an injection time or a fuel mass equal to zero, the next described torque monitoring is carried out. For this purpose, in step 118, the maximum permissible torque is determined on the basis of at least the engine rpm and on the driver command, that is, the driver command torque or accelerator pedal angle β. For this purpose, a pregiven characteristic field is used whose appearance is sketched in FIG. 3 based on the example of a constant engine rpm. When the monitoring is only carried out for β<threshold, one characteristic line is sufficient (permissible torque 100% up to maximum idle rpm and starting at 1500/min zero load or less than zero load). Such a trace of the permissible torque for this operating state is shown in FIG. 4. After determining the maximum permissible torque in step 120, the actual torque is computed on the basis of the computed relative fuel mass which is injected, as well as efficiency grades with respect to the injection time point, the ignition time point, the actual lambda adjustment as well as the actual throttle flap position (dethrottling), et cetera. This computation takes place via multiplication of the fuel mass and the degree of efficiency which defines the percent influence of the deviation of the particular operating quantity from a standard quantity for which the relationship between the relative fuel mass the actual torque is described.

After step 120, a check is made in step 122 as to whether the actual torque is less than the maximum permissible torque. If this is the case, then one can assume a correct operation and the program is ended. If the actual torque exceeds the maximum permissible torque, then the fault reaction in accordance with step 140 is initiated and the program is thereafter ended as well as run through anew in the next interval. In the preferred embodiment, this fault reaction comprises bringing the engine to standstill, for example, by switching off the fuel metering and/or the ignition at least so long until the actual torque has again dropped below the permissible torque.

In another advantageous embodiment, and in addition to the comparison of the actual torque and maximum permissible torque in accordance with step 122, the determined engine torque is compared to the desired torque, which is pregiven in dependence upon the driver command torque, and the pregiven desired torque is compared to the maximum permissible torque. In this case, a fault reaction is initiated when the determined engine torque exceeds the pregiven desired torque and/or at the same time, the desired torque lies above the maximum permissible torque.

A characteristic field is provided or a simplified function model of the control apparatus for determining the maximum permissible torque in dependence upon the driver command and the engine speed. The measured quantities are assigned to the maximum permissible torque via this simplified function model. Here, it is provided that the permissible torque is always less than the zero torque at small pedal angles, that is, the engine may not output a positive torque. At larger pedal angles for which an overrun operation is present, the maximum permissible torque is at most the zero torque. For larger pedal angles, the permissible torque shows a trace increasing with the driver command. Below an accelerator pedal angle of 2% (released accelerator pedal), only a maximum negative torque is permitted. Up to an accelerator pedal angle of 10% (here too, the accelerator pedal is released), the zero torque of an acceptable maximum rpm is permitted. Above the accelerator pedal angle of 10% (actuated pedal), a trace of the maximum permissible torque is shown and this trace increases with the accelerator pedal angle.

A preferred embodiment is shown in FIG. 4. In this embodiment, a monitoring is carried out for an accelerator pedal position less than a threshold. FIG. 4 shows the trace of a characteristic line wherein the maximum permissible torque mizul is converted to the torque which is outputted by the engine at the output shaft and this torque is plotted against the engine speed (rpm). The permissible torque is 100% to maximum idle speed (1500/min) and starting at 1500/min zero load or less than zero load.

The monitoring measure described above is applicable to gasoline internal combustion engines, which operate at a lean air/fuel mixture, for example, engines having gasoline direct injection as well as to diesel engines.

What is claimed is:

1. A method for operating an internal combustion engine which is operated in at least one operating state with a lean air/fuel mixture, the method comprising the steps of:

determining the fuel mass as a first quantity, which is to be injected, in dependence upon a desired value;

determining an injection time as a second quantity, which is to be outputted, and outputting the injection time;

determining an actual torque of the engine from at least one of said quantities and comparing to a permissible torque;

initiating a fault reaction when the actual torque is greater than the permissible torque;

making a check as to whether a quantity, which represents the oxygen concentration of the exhaust gas, exceeds a predetermined limit value; and, initiating a fault reaction when a measured value of said oxygen concentration does not exceed the limit value.

2. The method of claim 1, wherein the injected fuel mass is determined on the basis of injection time.

3. The method of claim 1, wherein the actual torque is computed from the actually injected fuel mass and efficiency grades of operating quantities including at least one of injection time point, ignition angle and dethrottling.

4. The method of claim 1, wherein the maximum permissible torque is determined at least on the basis of the driver command and the engine speed in such a manner that, for smallest driver command values, the engine outputs only negative torque and, for small driver command values, only outputs maximally zero torque and, for larger driver command values, a driver command dependency of the maximum permissible torque is pregiven in the region of positive torques.

5. The method of claim 1, wherein, when the maximum permissible torque is exceeded by the computed actual torque, the fuel metering is switched off at least until the actual torque again drops below the maximum permissible torque.

6. The method of claim 1, wherein the monitoring of the quantity for the oxygen concentration then takes place when an operating state is present wherein no injection time is outputted.

7. The method of claim 1, wherein the injected fuel mass is determined from the supplied air mass and the exhaust-gas composition.

8. A method for operating an internal combustion engine which is operated in at least one operating state with a lean air/fuel mixture, the method comprising the steps of:

determining the fuel mass as a first quantity, which is to be injected, in dependence upon a desired value;

determining an injection time as a second quantity, which is to be outputted, and outputting the injection time;

determining an actual torque of the engine from at least one of said quantities and comparing to a permissible torque;

initiating a fault reaction when the actual torque is greater than the permissible torque;

comparing a quantity, which represents the oxygen concentration in the exhaust gas, to an operating-point dependent permitted range; and, initiating a fault reaction when leaving the permitted range.

9. The method of claim 8, wherein the fault reaction, which is initiated in dependence upon the quantity for the oxygen concentration in the exhaust gas, comprises that the engine is driven with a stoichiometric mixture and that the actual torque is computed on the basis of the measured air mass.

10. The method of claim 8, wherein said engine includes an accelerator pedal; and, additionally, for a smallest angle of said accelerator pedal, the injection time is monitored to the value zero when no exceptional operating state is present including catalytic converter protection, catalytic converter heating and/or holding the catalytic converter warm.

11. The method of claim 8, wherein the determined engine torque is compared to the pregiven desired torque and the pregiven desired torque is compared to the maximum permissible torque.

12. An arrangement for operating an internal combustion engine which is operated in at least one operating state with a lean air/fuel mixture; the arrangement comprising:

a control apparatus which includes at least one microcomputer which functions to determine the fuel quantity, which is to be injected, in dependence upon a desired value and to determine an injection time to be outputted;

means for outputting this injection time;

the microcomputer functioning to determine the actual torque of the engine on the basis of at least one of these values and to compare this torque to a maximum permissible torque and to initiate a fault reaction when the actual torque exceeds the maximum permissible torque; and, the microcomputer receiving a quantity, which represents the oxygen concentration of the exhaust gas and comparing this quantity to at least one pregiven limit value and initiating a fault reaction when this limit value is exceeded.

13. An arrangement for operating an internal combustion engine which is operated in at least one operating state with a lean air/fuel mixture; the arrangement comprising:

a control apparatus which includes at least one microcomputer which functions to determine the fuel quantity, which is to be injected, in dependence upon a desired value and to determine an injection time to be outputted;

means for outputting this injection time;

the microcomputer functioning to determine the actual torque of the engine on the basis of at least one of these values and to compare this torque to a maximum permissible torque and to initiate a fault reaction when the actual torque exceeds the maximum permissible torque; and, the microcomputer receiving a quantity, which represents the oxygen concentration of the exhaust gas and comparing this quantity to an operating-point dependent permitted range and initiating a fault reaction when leaving the permitted range.

14. The method of claim 2, wherein said injected fuel means is determined on the basis of injected time while considering fuel pressure.

* * * * *